US005372267A

United States Patent [19]

Hofmann

[11] Patent Number: 5,372,267

[45] Date of Patent: Dec. 13, 1994

[54] SAFETY CONTAINER AND DISPENSER FOR SMALL ITEMS

[75] Inventor: Richard W. Hofmann, Chicago, Ill.

[73] Assignee: Magenta Corporation, Chicago, Ill.

[21] Appl. No.: 85,632

[22] Filed: Jun. 30, 1993

[51] Int. Cl.[5] ..... B65D 55/02

[52] U.S. Cl. ..... 215/220; 215/214; 215/217; 221/4; 221/154; 221/306; 206/536

[58] Field of Search ..... 206/528, 536, 537, 540; 215/214, 217, 220, 223, 233, 343; 221/4, 154, 306

[56] References Cited

U.S. PATENT DOCUMENTS

| | | | |
|---|---|---|---|
| 2,752,060 | 6/1956 | Martin | 215/217 |
| 3,095,085 | 6/1963 | Meijer | 206/536 |
| 3,402,842 | 9/1968 | Millian | 215/217 |
| 3,678,884 | 7/1972 | Robbins | 206/536 |
| 4,007,850 | 2/1977 | Beaugrand | 215/217 |
| 4,784,288 | 11/1988 | Jennings | 206/536 |
| 4,971,203 | 11/1990 | Weinstein | 206/536 |
| 5,099,999 | 3/1992 | Balien | 206/536 |
| 5,129,533 | 7/1992 | Loffler | 215/343 |
| 5,141,129 | 8/1992 | Jennings | 206/536 |

FOREIGN PATENT DOCUMENTS

| | | | |
|---|---|---|---|
| 1051007 | 12/1966 | United Kingdom | 215/343 |

*Primary Examiner*—David T. Fidei
*Attorney, Agent, or Firm*—Laff, Whitesel, Conte & Saret, Ltd.

[57] ABSTRACT

A child-resistant container according to the present invention comprises a container body and a cup-shaped closure which is installed telescopically over the open end of the container body. Mating longitudinal splines and ribs are provided on the adjacent walls of the container body and the closure to interfere with one another as the closure is longitudinally urged from a closed position to an open position. The spline and rib patterns are selected so that the splines and ribs interfere unless the closure is oriented in a predefined angular unlocked position with respect to the container body. A cylindrical ledge of slightly increased diameter is provided on the container body longitudinally adjacent the splines. The ledge prevents a user from discovering the unlocked position by rotating the closure and feeling reduced resistance when the unlocked position is reached. A cylindrical plug seal is extends from a top wall of the closure to engage the open end of the container body when the closure is in the closed position. In one embodiment, the closure is formed as a cup, and the closure must be separated from the container body in order to remove objects contained therein. In another embodiment, the closure has a side wall aperture which is unblocked to form a dispensing orifice when the closure is in the open position. The closure wall aperture is formed by relieving or omitting a portion of the cylindrical side wall of the closure from a bottom edge of the aperture through the top wall, with side edges extending parallel to a longitudinal axis of the closure.

11 Claims, 5 Drawing Sheets

Fig. 1
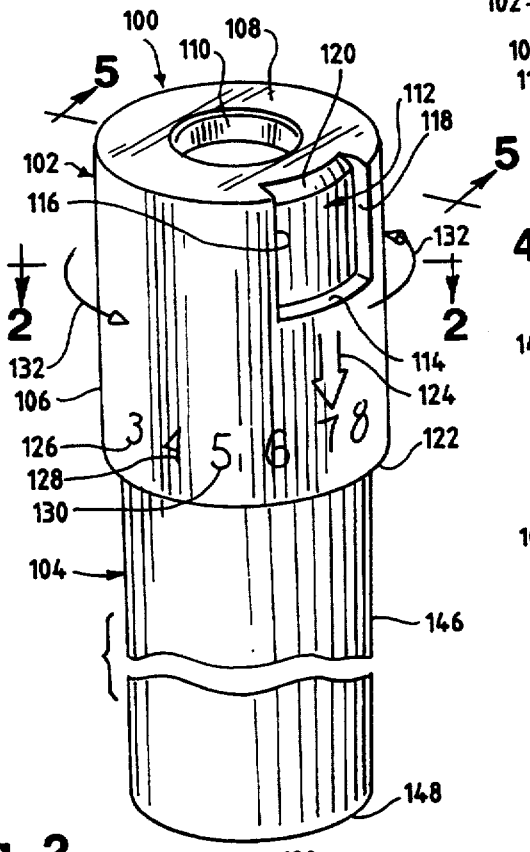
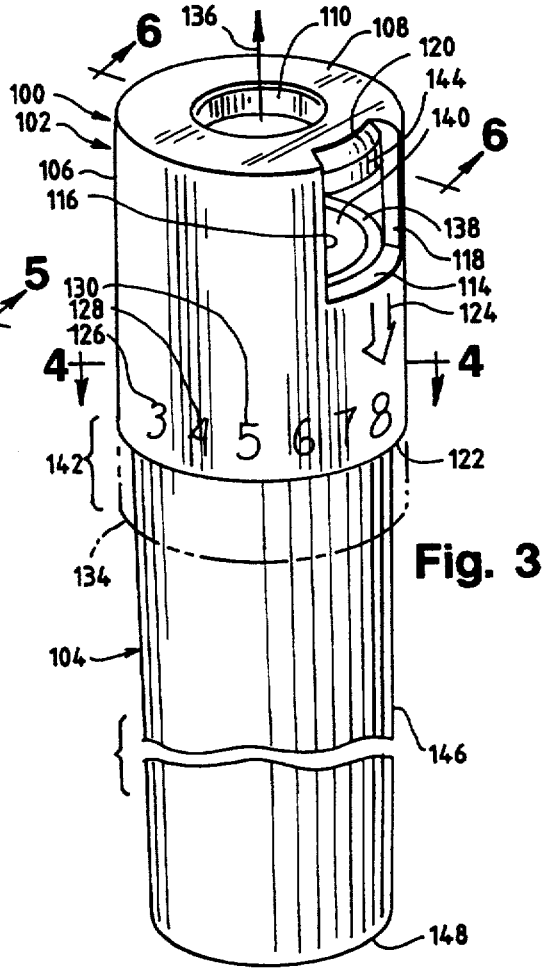
Fig. 3
Fig. 2
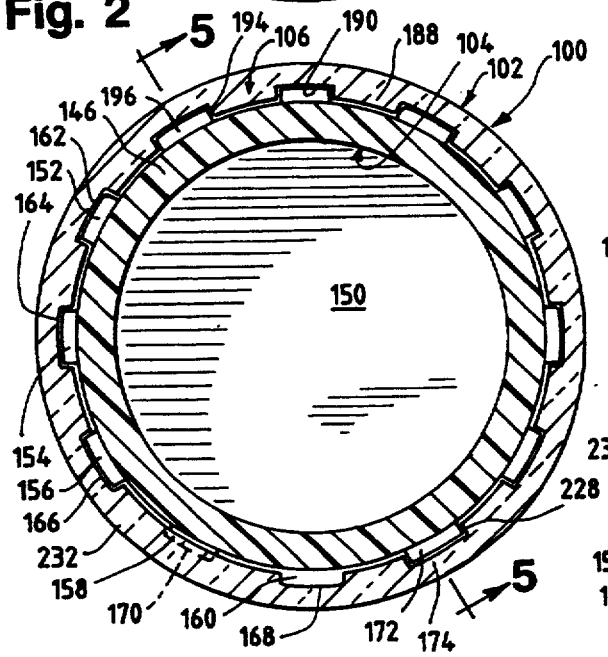
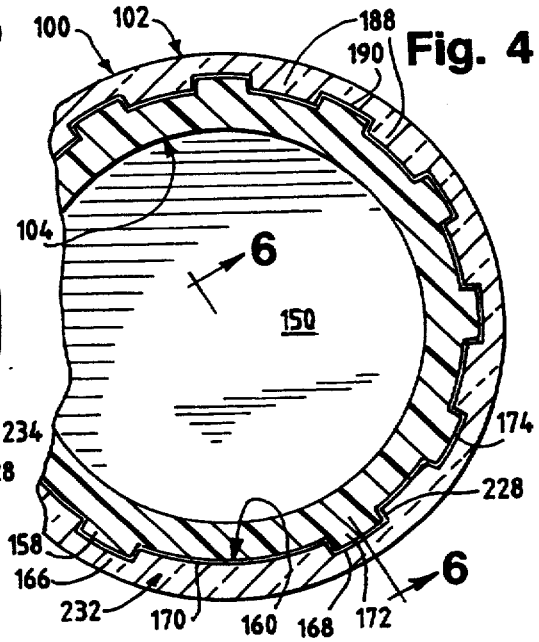
Fig. 4

SAFETY CONTAINER AND DISPENSER FOR SMALL ITEMS

BACKGROUND OF THE INVENTION

This invention relates to containers for small items, and more particularly containers for convenient use by an adult to store and dispense pills, capsules, or other small articles, while generally prohibiting access to such articles by children.

A variety of products, such as medicines, dietary supplements, and the like, are distributed in the form of small pills, tablets, or capsules. Although these products may be safe and effective when used properly, they can be extremely dangerous if improperly used, and the potential for improper use by children is especially high. Often, the size, shape, and bright colors of these items makes them resemble candy or other foodstuffs. Many children may be too young to appreciate the danger of eating things they are not supposed to, and even those who understand that some things should not be eaten may be unable to distinguish items which are safe to eat from potentially dangerous items.

Unfortunately, most pills and similar items cannot be made inherently safe from improper use by children and others who may be unable to appreciate the danger presented by the product. Accordingly, a variety of child-resistant containers have been developed to contain such products, permitting access to the contents by adults while precluding access to the contents by children. Many typical child resistant containers have the general size and shape of a conventional pill or tablet container, but include a child-resistant closure to prevent a child from gaining access to the contents. Such closures generally include an obstacle feature which is intended to be relatively difficult for a child to avoid but which is intended to be easily overcome by an adult.

For example, some of these closures require the user to undergo a relatively complicated or difficult-to-understand operation in order to open the container. The nature of the operation is usually not apparent from the structure of the container, but is explained by instructions printed upon the container or closure. Thus, a user must be able to read, understand, and remember an abstractly complex series of mechanical operations in order to release the closure. This obstacle tends to preclude operation by those children who are too young to appreciate the danger of consuming the contents of the container.

In addition to the abstract complexity of the operation which is required to release the closure, the operation is typically made difficult for a child to perform, by requiring significant strength, manual dexterity, or the ability to do several things simultaneously. For example, one common closure used with certain containers for prescription medications requires the user to urge the closure toward the container with significant force, while simultaneously rotating the closure with respect to the container until the closure is released. Another closure, commonly used with certain containers for non-prescription medicine, requires the user to angularly align a single index mark on the closure with a mating index mark on the container, and then apply significant upward pressure to a specific location on the closure, until it is released.

Unfortunately, although some of these prior art containers and closure combinations are effective in preventing children from opening the container, they are sometimes also effective in preventing the intended adult users from opening the containers. Many potential users suffer from one or more conditions which impair their strength or manual dexterity, and some of these people find opening the prior-art containers difficult or impossible. This is a significant disadvantage, because people who are ill and therefore need medication are the most likely to suffer from a condition which exacerbates the difficulty of opening the container.

Another disadvantage of prior art containers is that when the closure is removed, a large opening is exposed through which many items may pass easily. This makes it easy to lose a substantial portion of the container contents if the container is accidentally upset. People who have conditions which impair their strength or manual dexterity may be more likely to upset the container.

Also, since the closure of prior-art containers must be completely removed from the container to remove the contents, the closure is also subject to loss.

Further, a typical medication user needs only a small number of items of a particular type at any one time. For example, a user of an aspirin-containing pain relief medication might take one or two tablets at a time. Despite this usage pattern, conventional containers do not facilitate isolating and removing one or two of the items for use at one time. Instead, when a conventional pill container is employed, the user may insert his or her fingers into the container to select an item and drag it along an interior wall until it reaches the mouth of the container where the item may be grasped. This exposes all of the remaining items to contamination from extraneous matter carried on the user's fingers. Alternatively, the user may try to tip the container such that a desired number of items fall out, However, it is difficult to cause exactly the desired number of items to fall out. If more than the desired number fall out, the user must return them to the container, thereby exposing the unused items to contamination or loss. Although at first glance these may seem to be trivial barriers to use, there are persons having various impairments for whom extracting a desired number of items from a conventional container is very difficult.

U.S. Pat. No. 4,971,203 to Weinstein discloses a child-resistant pill dispenser which dispenses a small number of items. Weinstein discloses a cylindrical container body having a closed end and an open end. A cup shaped closure having an inner diameter slightly larger than the outer diameter of the container is telescopically mounted to cover the open end of the container. In one embodiment, the closure has a retaining peg or cam which engages a retaining groove provided on the container. The retaining groove is generally circumferential, but has attached thereto an additional section extending longitudinally toward the open end of the container. The retaining groove and cam cooperate so that when the cam is in the circumferential portion of the groove, the closure may generally rotate but is retained in a first longitudinal position. However, when the closure is rotationally positioned so that the cam can follow the retaining groove's longitudinal extension, the closure may be longitudinally displaced a small distance away from the container's closed end to a second longitudinal position. (in another embodiment, a retaining groove is provided on the closure, and a cam is provided on the container, but the components cooperate in much the same way.)

A dispensing orifice is provided in the container body near the open end. This dispensing orifice is normally covered by the closure. However, the closure has a matching orifice which is so located that the two orifices are overlappingly aligned only when the closure is in its second longitudinal position. Thus, in order to dispense an item, the closure must first be rotated to a predetermined rotational position to align the cam with the retaining groove's longitudinal extension, and then must be longitudinally displaced to align the dispensing orifices.

The Weinstein dispenser suffers from several significant disadvantages. Because the retaining groove's longitudinal extension section is connected to the circumferential section, the extension portion may be discovered by rotating the closure while applying slight pressure in the direction of the extension. When the cam reaches the extension, a slight bump may be felt, or the cam may enter the extension. Thus a child who happens upon the Weinstein dispenser and plays with it may easily defeat its child-resistant feature.

Another disadvantage of the Weinstein dispenser is when the closure is in its open, longitudinally displaced position, items in the container may become lodged between the open end of the container and the closure, thereby preventing the closure from being returned to its normal (closed) position. Also, Weinstein lacks a seal between the container and the closure, permitting moisture and extraneous materials to enter the container, even when closed, thereby contaminating the contents.

Another disadvantage is that the Weinstein dispenser is expensive and difficult to construct with modern automated equipment. Weinstein's dispensing orifices are oval-shaped and positioned in a manner that makes fabrication by popular and inexpensive injection molding techniques difficult, and requires additional manufacturing operations. Also, due to the configuration of the retaining groove and mating cam, the closure and the container must be suitably oriented in a predefined relationship when assembled together. It may also be necessary to install the cam as a separate manufacturing operation after the closure and the container have been assembled.

OBJECTS AND SUMMARY OF THE INVENTION

It is therefore an object of the present invention to provide a container for pills, dietary supplements, and other items which prevents children, and others unable to appreciate the dangers of improper use, from gaining easy access to the contents.

It is a further object of the invention to provide a container for small, potentially dangerous, solid items which allows intended users convenient access to the contents while denying access to children and other unintended users.

It is another object of the invention to provide a child resistant container having a security feature which presents an obstacle which must be overcome in order to gain access to the contents and which includes an additional feature to prevent children and others from discovering how to defeat the obstacle.

It is a further object of the invention to provide a child resistant container having a closure which must be placed in an unlocked position in order to gain access to the contents and which includes an additional feature to prevent children and other unintended users from discovering: the unlocked position.

It is another object of the invention to provide a child resistant container which provides a seal between the container and its closure, thereby preventing; infiltration of moisture and other contaminants.

It is another object of the present invention to provide a child resistant container and associated closure which may be conveniently and inexpensively manufactured using modern injection molding techniques and which requires a minimum of side operations to complete manufacture.

It is a further object of the present invention to provide a small child-resistant container for small, solid objects which conveniently dispenses one or a small number of objects at a time.

A child-resistant container constructed according to the present invention comprises a container body, which may be substantially cylindrical, having a closed end and an open end, and a cup-shaped closure which is installed telescopically over the open end of the container body.

A plurality of longitudinal splines are arranged in a circumferential band on the exterior wall of the container body near the open end, and a corresponding set of ribs and slots are provided on the interior wall of the closure body. The container splines and the closure ribs are longitudinally positioned so as to interfere with one another as the closure is longitudinally urged from a closed position to an open position. The spline and rib patterns are selected so that the splines and ribs interfere unless the closure is located in a predefined angular "unlocked" orientation with respect to the container body.

A cylindrical ledge of slightly increased diameter is provided on the container body longitudinally adjacent the splines. The ledge prevents a user from discovering the unlocked position by rotating the closure and feeling reduced resistance when the unlocked position is reached.

A cylindrical lip having a diameter slightly smaller than the diameter of the closure side wall extends inward from the closure top wall to form a seal. The seal engages the upper lip of the open end of container body when the closure is in the closed position, thereby preventing infiltration of moisture and other contaminants. A depression fills some of the interior space in the vicinity of the seal to prevent stored items from interfering with the seal.

In one embodiment, the closure is formed as a cup, and the closure must be separated from the container body in order to remove objects contained therein. In another embodiment, the container is adapted to conveniently dispense one or a small number of objects at a time. In this embodiment, the closure is generally cup-shaped, but has an aperture in its side wall. When the closure is in an open position, the closure wall aperture is located above the upper edge of the container body and forms a dispensing orifice through which items may be dispensed, one at a time. When the closure is in the closed position, the closure aperture is blocked by the body wall of the container body. The closure wall aperture is formed by relieving or omitting a portion of the cylindrical side wall of the closure from a bottom edge of the aperture through the top wall, with side edges extending parallel to a longitudinal axis of the closure. This enables the closure to be conveniently and inexpensively formed using modern injection molding techniques without requiring costly and time consuming side operations.

BRIEF DESCRIPTION OF THE DRAWINGS

These and other features of this invention will be best understood by reference to the following detailed description of a preferred embodiment of the invention, taken in conjunction with the accompanying drawings, in which:

FIG. 1 is a front perspective view of a first embodiment 100 of a safety container constructed according to the present invention, showing the container fully assembled and in its closed state;

FIG. 2 is a downward cross-section view of the safety container of FIG. 1, taken along section lines 2—2 thereof;

FIG. 3 is a front perspective view of the safety container of FIGS. 1-2, showing the container in its open state;

FIG. 4 is a downward cross-section view of the safety container of FIG. 3, taken along section lines 4—4 thereof;

DETAILED DESCRIPTION OF THE PREFERRED EMBODIMENT

Figure 10:
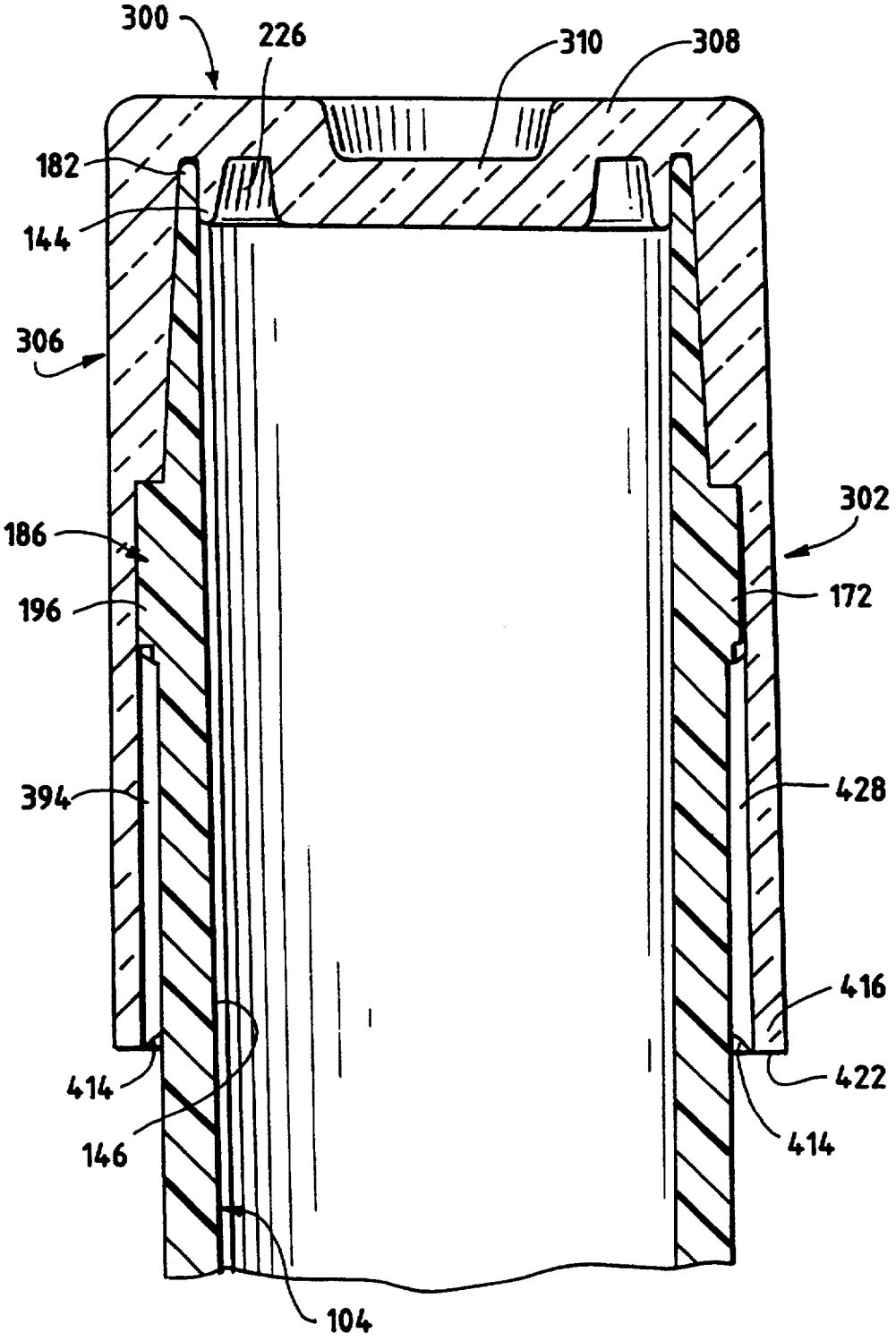
FIG. 10 is a side cross-section view of a second embodiment 300 of a safety container constructed according to the present invention, showing the container in its closed position.
Figure 11:
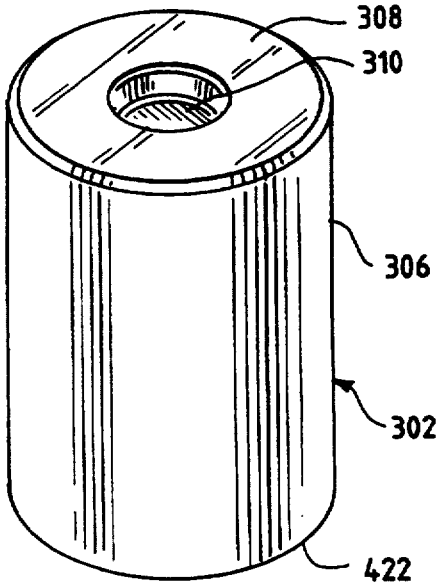
FIG. 11 is a front isometric view of a closure 302 for use with the a safety container 300 of FIG. 10.

A first preferred embodiment 100 of a safety container constructed according to the present invention is shown in FIGS. 1-9. A second preferred embodiment 300 of the container is shown in FIGS. 10-11.

In brief, containers 100, 300 are each child-resistant safety containers intended to store a plurality of small items, such as pills, tablets, capsules, or the like, which are commonly used as delivery vehicles for medicines, dietary supplements, and other pharmacological products. Although it is contemplated that the containers 100, 300 are likely to be highly useful for storing ingestible, health-related products, the containers would also be useful for storing any other small, discrete, substantially solid objects, to which children, and others who may be unable to appreciate the danger of improper use, should be denied access. For convenience, the term "items" is used herein to denote any object to be stored in the containers 100, 300.

The containers 100, 300 are generally similar, but the container 100 provides additional features in order to conveniently dispense a small number of items at one time. A description of container 100 will be provided first, followed by a description of the differences between container 100 and container 300. In general, identical reference numbers will be used to refer to identical elements of both containers 100, 300.

Figure 9:
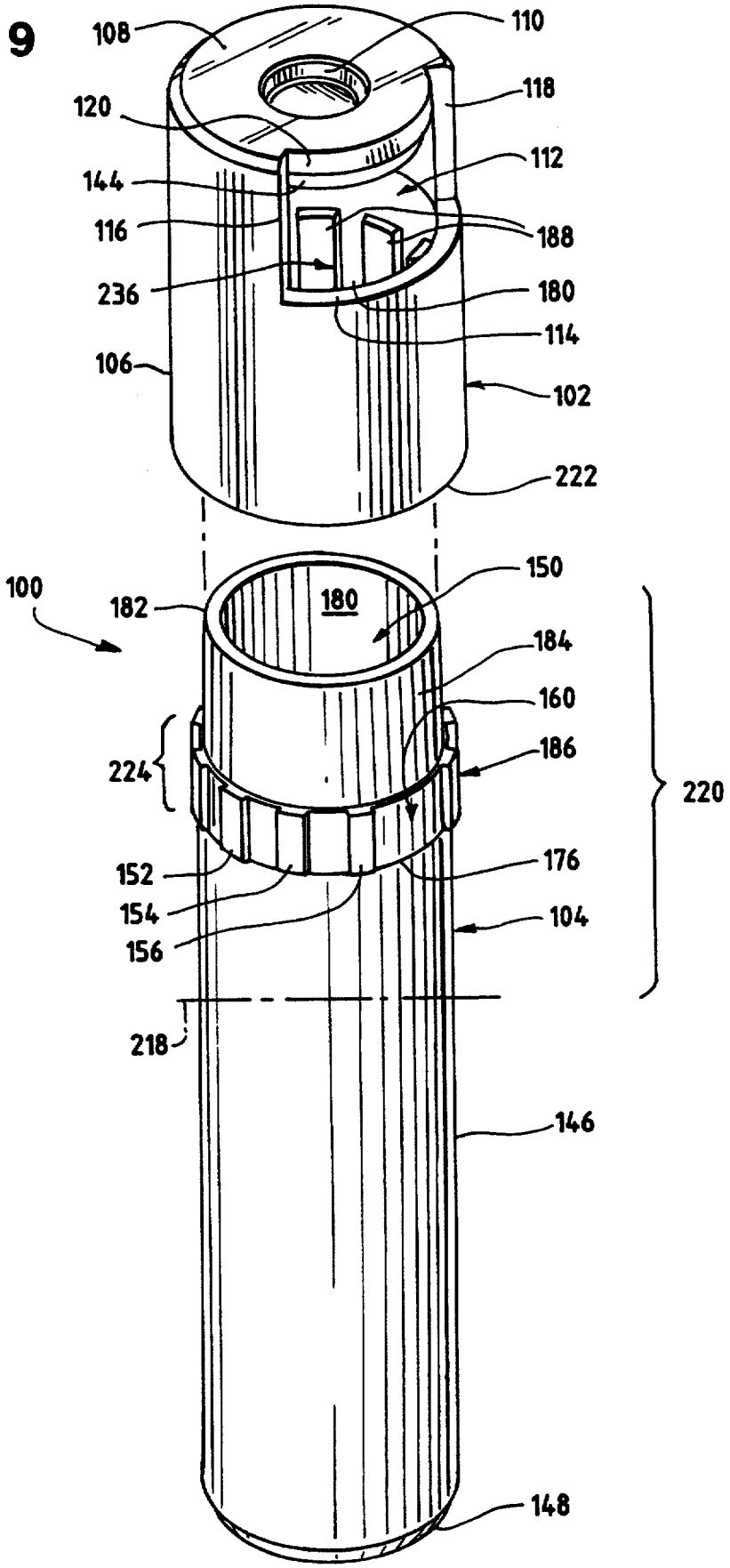
FIG. 9 is an exploded front isometric view of the safety container of FIG. 1, showing separately a container portion and a closure portion thereof.

The general structure of safety container 100 is best seen in FIGS. 1, 3, and 9. Container 100 comprises a container body 104 and a mating closure 102. The container body 104 may be formed as an elongated tubular structure having a substantially cylindrical inner body wall 140 and outer body wall 146, a closed bottom end 148, and an open top end 138 defining container mouth 180. The inner body wall 140, closed bottom end 148, and container mouth 180 cooperate to define a container region 150 within the body 104 for containing objects of the type described above.

Although the container body 104 is shown in the drawings and described herein as substantially cylindrical, in fact, it is actually only necessary that the small upper portion 220 of the body 104 which interfaces with closure 102 (i.e., the portion 220 which is above the broken line 218 (FIG. 9)) have a particular shape to match the inner shape of the closure 102. The remainder of the lower portion of the body 104 could be any suitable shape or cross-section, and could, for example, incorporate at least one flat surface (not shown) to prevent the container from rolling off an inclined surface. Furthermore, the particular shape of the closure interface section 220 may be selected from a variety of shapes which are generally rotationally symmetric about a longitudinal axis of the body 104. A body 104 having the substantially cylindrical shape shown herein is believed to be preferable because it may be efficiently and inexpensively manufactured using commonly available injection molding techniques.

As best seen in FIG. 9, a closure interface portion 220 of the body 104 extending above the broken line 218 is adapted to interface with the closure 102. As shown herein, the closure 102 is generally cup-shaped and has an inside diameter which is slightly larger than the outside diameter of the container body portion 220. Thus, in order to close the container body 104, the open end 222 of the closure 102 is fit over the open end 180 of container body 104 in an overlapping telescoping relationship.

The closure interface portion 220 comprises the open end 180 of the container body 104, the upper lip 182 of the body, a transition section 184 of the body immediately below the lip 182, and locking means 224. The transition section 184 is preferably conically tapered between the locking means 224 and the upper lip 182 so that its outside diameter is slightly reduced as the upper lip is approached.

The locking means 224 performs the dual functions of retaining the closure 102 in desired positions with respect to the body 104 and preventing children, and others who may be unable to appreciate the danger of improper use of the contents, from opening the container. As best seen in FIGS. 5-9, the locking means 224 comprises a circumferential interference ledge 176 immediately below the transition section 184, and a group of splines 186 arranged in a substantially regular pattern along the circumferential ledge. The interference ledge 176 is formed by creating a horizontal band of slightly larger diameter on the outside of the container body.

The splines 186 are formed as longitudinally-extending strips of further increased diameter. The function of the locking means 224 will be described infra in greater detail.

As best seen in FIGS. 1, 3, and 9, the closure 102 is generally cup-shaped and comprises a substantially cylindrical body wall 106 having one end closed by an end wall 108, and the remaining end 222 open. As best seen in FIG. 9, closure 102 has a second locking means 236 located on the interior surface of the closure body wall 106. The second locking means 236 cooperates with the locking means 224 of the container body 104 to provide a child-resistant access feature, and for retaining the closure 102 in desired positions with respect to the container body 104. The locking means 236 will be described infra in greater detail.

A dispensing orifice 112 is preferably provided in the wall 106. The dispensing orifice is defined by left and right side edges 116, 118, a bottom edge 114, and a top edge 120. The orifice may be created by relieving or omitting to form the portion of the wall 106 defined by these edges. Preferably, the omitted wall portion extends longitudinally upward from the bottom edge 114 through the top 108 of the closure, and the left and right side edges 116, 118 are preferably substantially parallel with the longitudinal axis of the closure 102. When commonly available injection molding techniques are used, these constraints permit the orifice to be molded in the direction of the draw and avoid the need for side actions, thereby reducing the cost and complexity of the mold, and improving the molding cycle time.

Figure 5:
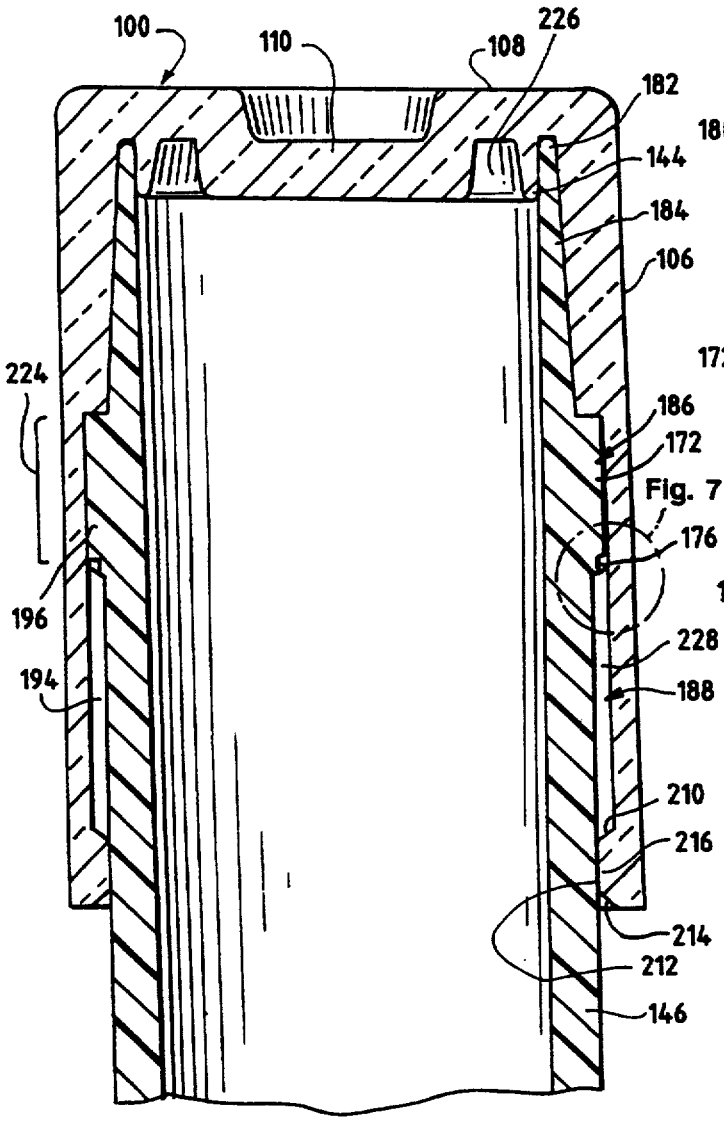
FIG. 5 is a side cross-section view of the safety container of FIG. 1, taken along the section lines 5—5 thereof.

As best seen in FIGS. 1, 3, 5, 6, and 9, the closure 102 preferably has a seal means which cooperates with the container body 104 to seal the container when the closure 102 is in a closed position (see FIGS. 1 and 5). The seal means may be formed by any suitable seal, gasket, or the like. The seal means 144 is preferably formed as a cylindrical lip 144 which extends downward from the interior surface of the closure top wall 108. The cylindrical lip 144 thus forms a plug which extends into the open end 180 of the container body when the closure 102 is in the closed position (see FIG. 5). Preferably, the cylindrical lip 144 is resilient and has an outer diameter which is slightly larger than the inner diameter of the upper lip 182 of the container body 104. Urging the closure 102 downward into the closed position causes the lip 144 to be compressed inwardly, producing a tight interference seal with the inner surface 140. This seal means advantageously prevents contaminants, such as dust and water vapor, from entering the container when it is intended to be closed.

The closure 102 preferably includes a depression 110 in the top wall 108. The depression 110 helps prevent items from catching on the lip 144, which otherwise might interfere with dispensing. An empty region 226 is provided between the lip 144 and the depression 110 so that the depression does not affect the resilience of the lip 144 or its movement when being compressed.

As best seen in FIGS. 1, 3, 5, and 6, when the container body 104 and the closure 102 are assembled to form the container 100, the closure 102 has a closed position (FIGS. 1 and 5), and an open position (FIGS. 3, 6) in which the closure 102 is displaced upwards (indicated by arrow 136) by a distance 142 (FIG. 3) from the closed position (indicated in FIG. 3 by the phantom line 134). The container body 104 has a locking means 224 which cooperates with a corresponding locking means 236 on the closure.

Although any appropriate cooperative locking means 224, 236 could be used, as best seen in FIGS. 2 and 4–9, a preferred locking means according to the present invention incorporates a plurality of longitudinal splines 186 arranged circumferentially on the exterior surface of the container body 104, and a corresponding plurality of longitudinal slots 190 on the interior surface of the closure body 106 for receiving the splines 186. Slots 190 are preferably formed as the vacancies between opposing ribs 188 on the interior surface of the closure body.

As best seen in FIGS. 2 and 4, preferably the splines 186 are provided at regular angular intervals about the circumference of the container body wall 146, as shown by exemplary equally sized splines 196, 152, 154, 156, 158, and 172. However, one spline is omitted at one of the regular intervals 160. Corresponding slots 190 are provided at equivalent angular intervals about the inner surface of the closure body 106 as shown by exemplary slots 194, 162, 164, 166, and 174. A slot is omitted at one of the regular intervals 170. The omitted spline position 160 and the omitted slot position 170 cooperate to form a key rib 232 and a key slot 234, which mate only when the closure 102 is in a single predefined angular orientation with respect to the container body 104. Only in that orientation can the closure be pulled up into the open position. The predefined angular orientation is referred to herein as the "unlocked" orientation.

Figure 7:
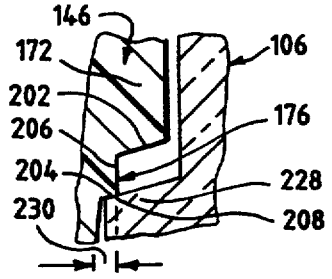
FIG. 7 is an enlarged detail of a portion of the cross section view of FIG. 5, taken along the view indicator 7 thereof.

As best seen in FIGS. 5 and 7, when the closure 102 is in the closed position, the tops 208 of ribs 188 and slots 190 of the closure body 106 are located below the bottoms 202 of splines 186 of the container body 146. Thus, in most angular orientations of closure 102 with respect to container body 104, at least one of the exterior container body splines 186 will interfere with at least one of the ribs 188 on the interior of closure body 106, to prevent the closure 102 from moving upward into the open position.

In several angular orientations, all but one of the exterior container body splines 186 will be aligned directly above a slot 190 on the interior of closure body 106. However, a remaining spline will be above the omitted slot position 170 on the closure body 106, and therefore, this remaining spline will interfere with the interior wall of the closure body 106. For example, as shown in FIG. 2 splines 152, 154, 156, etc. are respectively aligned with slots 162, 164, 166, etc. However, spline 158 is aligned with the omitted slot position 170, so that spline 158 will interfere with the interior wall of the closure body 106 to prevent the closure from being raised to the open position.

Figure 6:
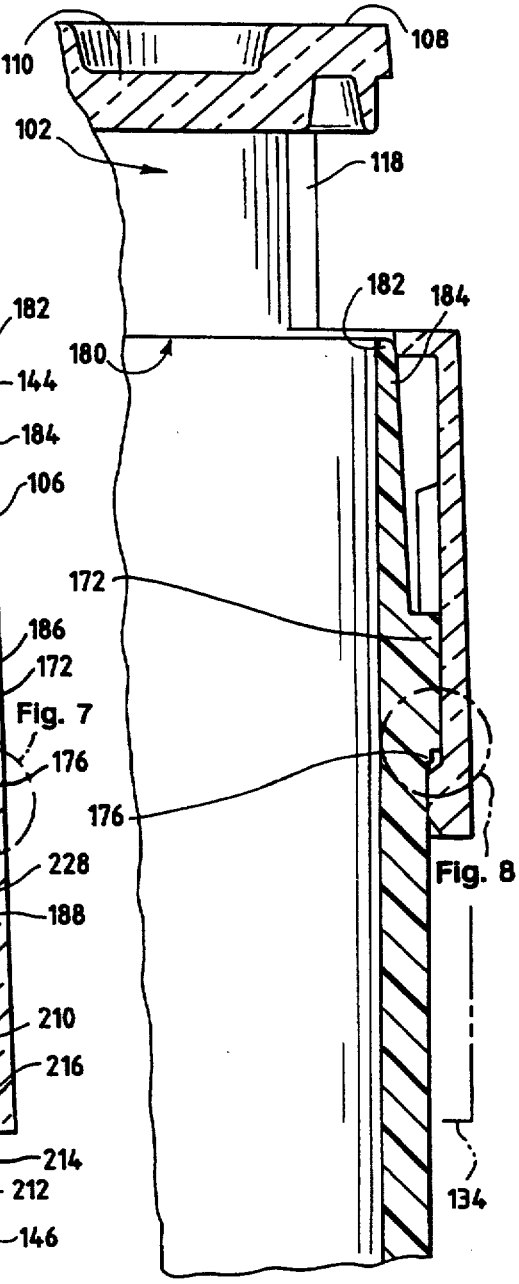
FIG. 6 is a side cross-section view of the safety container of FIG. 3, taken along the section lines 6—6 thereof.

As best seen in FIGS. 3, 4, and 6, only in a single predefined angular orientation, in which each of the container body splines 186 are aligned with a mating closure slot 190, and the omitted spline position 160 is aligned with the omitted slot position 170, no interference occurs between exterior splines 186 and interior splines 188, and only in that unlocked angular orientation can the closure 102 be raised to its open position.

A significant disadvantage of at least one prior-art child-resistant dispenser having a moving closure with a position-dependent unlocking feature is that the unlocked position is easily discovered by applying slight pressure toward the open position while rotating the closure through various angles, as a child might do while playing. The unlocked position is easily felt in the prior art device because at that position, a cam or peg, which rides in a retaining groove to limit the movement of the closure, is permitted to enter a longitudinal spur of the groove. Thus, the prior art unlocking feature presents substantially reduced resistance to longitudinal movement in that position, and a user can easily detect this.

Accordingly, the locking means 224 of the present invention includes means to mask the unlocked angular orientation so that it cannot be easily discovered. As best seen in FIGS. 5, 7, and 9, the locking means 224 comprises a circumferential interference ledge 176 which extends a small distance below container body splines 186. The ledge 176 has a bottom face 204 and a side face 206 which are circumferentially continuous.

In order to raise the closure 102 into the open position, a user must apply upward pressure on the closure 102. When light to moderate upward pressure is initially applied to the closure, the splines 190 on the interior of the closure 102 first encounter the interference ledge 176. For example, as best seen in FIGS. 5 and 7, the upper inside corner 208 of closure spline 228 bears against and interferes with the bottom face 204 of ledge 176. This interference prevents the container body splines 186 from entering closure slots 190. Since ledge 176 is circumferentially continuous, the interference is constant regardless of the angular orientation of the closure, and thus, even if a user applies a child like rotation with minor upward pressure through any angular displacement, no reduced resistance to longitudinal movement toward the open position can be felt.

The container body 104 and the closure 102 are preferably constructed of a suitable resilient plastic material, such as polyethylene, a polyacrylic ester, or polypropylene. As increased upward pressure is applied to the closure 102, the resilience of the materials from which the container body 104 and closure 102 are constructed permits the interference from ledge 176 to be overcome.

If the closure 102 is in the unlocked angular orientation, then the container body splines 186 may enter the closure slots 190 without incident, and the closure may be displaced longitudinally to the open position. However, if the closure 102 is not in the unlocked angular orientation, the container body splines 186 will interfere with closure ribs 188 to prevent further longitudinal displacement of the closure 102.

The distance 230 (FIG. 7) by which the diameter of ledge 176 exceeds the diameter of the container body wall 146 may depend in part on the particular material from which the container body wall 146 and closure body wall 106 are constructed, and in part on other dimensions, such as the thickness of walls 106, 146, and the diameter of these parts. The ledge step distance 230 and the resilience of the wall materials will affect the amount of force required to overcome tile interference of the ledge 176. Thus, selecting a suitable ledge step distance 230 may be important in providing a container which does not pose an unacceptable access barrier to intended users, who may have impaired strength and manual dexterity. In a tested commercial embodiment constructed of polypropylene, having a container body wall thickness 146 of 0.058 inches, a closure body wall thickness 106 of 0.025 inches, and a container body diameter of 0.656 inches, an interference ledge having a dimension 230 of 0.003 inches has been found suitable.

Although the previous discussion of the locking means 224, 236 and the associated figures have shown a particular arrangement of splines and corresponding slots, other arrangements could also be used. As best seen in FIGS. 10 and 11, the number of splines may vary, as may the relative sizes of the container splines and closure ribs. In addition, a key rib or key spline may be located on either the container body 104 or the closure 102, with a corresponding slot on the opposite part.

Figure 12:
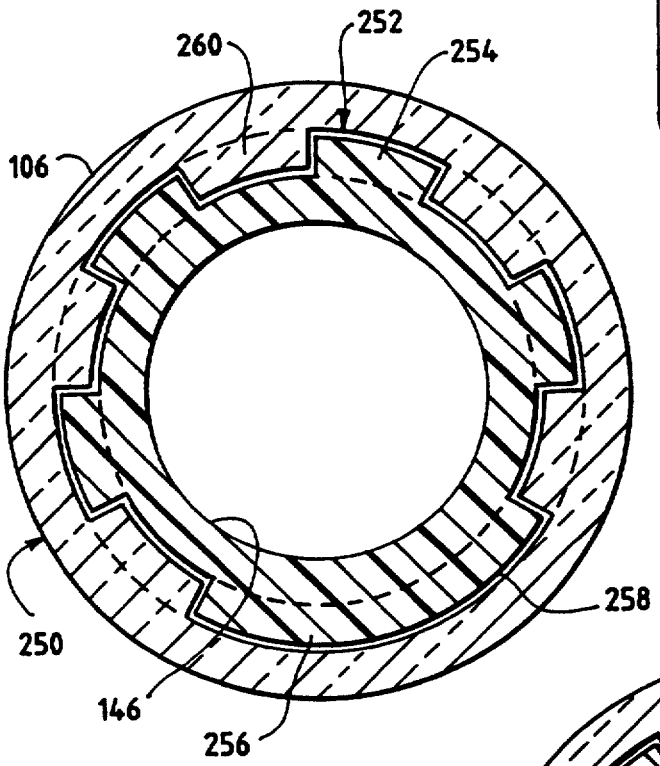
FIG. 12 is a cross-section view of a modified retaining means configuration for use with the safety containers of the present invention.

Thus, as shown in FIG. 12, a modified locking means 250 may comprise four ordinary splines 254 and one enlarged key spline 256 on the container body wall 146, along with five ordinary ribs 260 on the closure interior wall 106. Splines 254 and ribs 260 are approximately the same size. The ribs 260 form four ordinary slots 252 and one key slot 258 for receiving splines 254, 256 of the container body.

Figure 13:
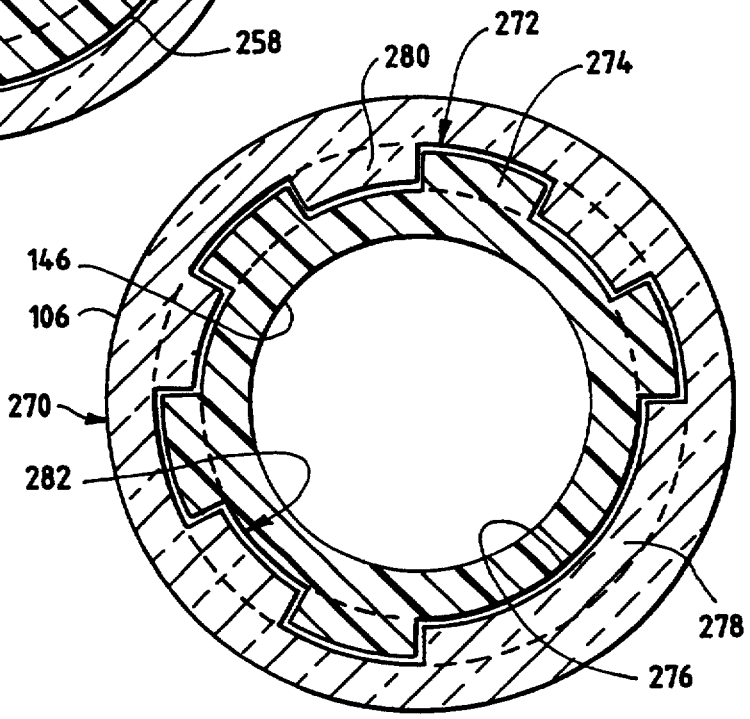
FIG. 13 is a cross-section view of another modified retaining means configuration for use with the safety containers of the present invention.

As shown in FIG. 13, a second modified locking means 270 may comprise five ordinary splines 274 on the container body wall 146, along with four ordinary ribs 280, and one enlarged key rib 278, on the closure interior wall 106. Splines 274 and ribs 280 are approximately the same size. The ribs 280 form slots 272 for receiving the splines 274 of the container body, and splines 274 form slots 282 for receiving ribs 278, 280 of the closure interior wall 106. Other alternative configurations could also be used. For example, each spline and rib could be a different size, provided that the splines and ribs form complementary slots for receiving one another in a predefined angular orientation of the closure 102 with the container body 104.

Figure 8:
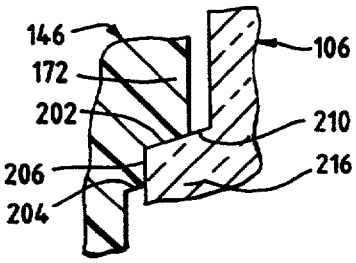
FIG. 8 is an enlarged detail of a portion of the cross section view of FIG. 6, taken along the view indicator 8 thereof.

Because container 100 conveniently dispenses the items stored therein as the user requires them, there is generally no need for the closure 102 to be separated from the container body 104 after the container has been filled and those parts have been assembled together. Further, if the closure 102 is separated from the container body 104, it may be lost. Accordingly, as best seen in FIGS. 5, 6, and 8, the closure 102 comprises means to retain it in operative attachment to the container body. A ring-shaped lip 216 projects inward from the interior of the side wall 106 of the closure near the open bottom end 122 thereof. The inner diameter of the closure lip 216 is smaller than the outer diameter of container body splines 186 (FIGS. 5–6) and 172 (FIG. 8) so that these parts will interfere. In order to assemble the closure 102 to the container body 104, the closure 102 is installed over the open end 180 of the container body, and sufficient downward pressure is supplied to deform the lip 216 and surrounding closure body wall 106 outward, so that the lip may pass the container body splines 186, 172. A chamfered lower edge 214 is provided on lip 216 to urge it to deform outwardly as it bears against the top of the splines 186, 172.

In normal operation (i.e., once the container body 104 and the closure 102 have been assembled), when the closure 102 is moved to its open position, the upper surface 210 (FIG. 8) interferes with the bottom edges 202 of splines 186 (FIGS. 5–6) and 172 (FIG. 8). Since the splines 186 extend virtually around the entire circumference of the container body 104, they effectively block the lip 216 from passing the splines. Thus, once assembled to the container body 104, closure 102 cannot be removed unless sufficient upward force is applied to deform the lip 216 so that it may pass the splines.

The container body 104 and the closure 102 preferably provide means for identifying the unlocked angular orientation in a manner which intended adult users will easily understand, but children will not. For example, as shown in FIGS. 1 and 3, a plurality of indicia 126, 128, 130 may be provided at various positions on the exterior of the container body 104, and an index mark 124 may be provided on the closure 102. The intended user is preferably advised of the particular indicium to which the index mark 124 must point in order to place the closure in the unlocked angular orientation.

There are several ways in which the intended user might be advised of the indicium corresponding to the unlocked location without making that indicium apparent to children and other users. For example, as illustrated in FIGS. 1 and 3, the indicia may be arabic numerals, and the user may be told orally of the numeral corresponding to the unlocked location by a pharmacist or technician. Alternatively, the corresponding numeral could be inscribed somewhere on the container or on a drug information sheet which may accompany the product when the user receives it. However, it is possible that a child may see the numeral on one part of the container, recognize that it corresponds to one of the position indicia, and defeat the locking means.

Accordingly, it would be preferable that if the unlocked position is identified on the container, the spelled-out name of the corresponding numeral be used, so that persons who cannot read, such as young children, would be unable to recognize it. Distinctive shapes, colored dots, and other indicia could be substituted for the numerals shown in FIGS. 1 and 3. Other indicia could also be used.

A second embodiment 300 of a container constructed according to the present invention is shown in FIGS. 10–11. The second embodiment 300 is similar to the first embodiment 100, but lacks the dispensing feature of the first embodiment 100. Since no portion of the container body 104 is directed to the dispensing feature, the container body 104 of the second embodiment 300 may be identical to that of the first embodiment 100.

Closure 302 is similar in most respects to closure 102 and is generally cup-shaped and comprises a substantially cylindrical body wall 306 having one end closed by an end wall 308, and the remaining end 422 open. Since closure 302 lacks the dispensing feature, no dispensing aperture is required, and the body wall 306 may be continuous. As best seen in FIG. 10, closure 302 preferably comprises a locking means, including longitudinal ribs 394, 428 for cooperation with the locking means 224 of container body 104.

Since closure 302 must be removed from the container body 104 in order to remove items, closure 302 preferably lacks the ring-shaped retaining lip 216 of closure 102. Instead, longitudinal ribs 394, 428 may extend downward to a location 416 near the open end 422 of closure 302. Since closure 302 lacks a retaining lip 216, only normal effort is required to install or remove the closure 302 once it has been located in the unlocked angular orientation. A chamfered bottom edge 414 may be provided on ribs 394, 428 to further aid installation of the closure on the container body. The container for closure 302 of course preferably has the interference ledge 176.

The above-described embodiments of the invention are merely examples ways in which the invention may be carried out. Other ways may also be possible, and are within the scope of the following claims defining the invention.

I claim:

1. A child-resistant dispensing container comprising a body and a closure, said body having an interfacing portion for interfacing with said closure, said interfacing portion having a longitudinal axis extending in a first direction, said closure being telescopically mounted to said body, said closure being adapted for rotation about said axis, said closure being adapted for limited movement along said first direction, said closure includes a substantially cylindrical body wall, locking means for preventing movement of said closure in said first direction unless said closure occupies a desired predetermined angular orientation with respect to body, said locking means comprises a plurality of longitudinal slots arranged cylindrically about an interior surface of said closure body wall and extending radially outward therefrom, and defeatable means separate from said locking means for resisting movement of said closure in said first direction regardless of whether said closure occupies said predefined angular orientation with respect to said body.

2. The article of claim 1 wherein:

said locking means further comprises a plurality of splines on said container body;

said longitudinal slots are formed by adjacent longitudinal ribs formed on said interior surface; and said ribs of said closure interfere with said splines of said container body upon attempted longitudinal movement of said closure away from said container body, unless said closure is oriented in a predefined angular relationship with respect to said container body.

3. The article of claim 1 wherein a plurality of possible spline locations are defined on said container body at regular angular intervals and a spline is provided at all but one of said defined locations.

4. The article of claim 3 wherein a plurality of possible slot locations are defined on said closure body wall interior surface at regular angular intervals and a slot is provided at all but one of said defined locations.

5. A child-resistant dispensing container comprising a body and a closure, said body having an interfacing portion for interfacing with said closure, said interfacing portion having a longitudinal axis extending in a first direction, said interface portion of said container body includes a substantially cylindrical container body wall, said closure being telescopically mounted to said body, said closure being adapted for rotation about said axis, said closure being adapted for limited movement along said first direction, locking means for preventing movement of said closure in said first direction unless said closure occupies a desired predetermined angular orientation with respect to said body, said locking means comprises a plurality of longitudinal slots arranged cylindrically about an exterior surface of said container body wall and extending radially inward therefrom, and defeatable means separate from said locking means for resisting movement of said closure in said first direction regardless of whether said closure occupies said predefined angular orientation with respect to said body.

6. The article of claim 5 wherein:

said closure includes a substantially cylindrical closure body wall;

said locking means further comprises a plurality of ribs on said closure body wall;

said longitudinal slots are formed by adjacent longitudinal splines formed on said exterior surface; and said ribs of said closure body wall interfere with said splines of said container body upon attempted longitudinal movement of said closure away from said container body, unless said closure is oriented in a predefined angular relationship with respect to said container body.

7. A child-resistant container comprising a container body and a closure;

said container body having an interfacing portion for interfacing with said closure;

said interfacing portion has a first wall section;

said closure has a second wall section which extends longitudinally and adjacent said first wall section;

said closure adapted for slidable longitudinal movement along said interfacing portion of said container body;

a first barrier on said closure;

said first barrier structure comprises at least one rib extending from said second wall section toward said first wall section;

a second barrier structure on said interfacing portion;

said second barrier structure having at least one opening therein;

said first and second barrier structure cooperating to prevent longitudinal movement of said closure with respect to said interfacing portion of said container body unless said first barrier structure may enter and pass through said at least one opening;

said first and second barrier structures further cooperating to permit exclusively longitudinal movement of said closure with respect to said interfacing portion of said container body when said first barrier structure enters said at least one opening;

said interfacing portion having defeatable interference means for resisting said first barrier structures from entering said at least one opening;

said interference means comprising at least one horizontal ledge extending from said first wall section toward said second wall section; and said first barrier structure interfering with said interference means to prevent said second barrier structure from entering said openings.

8. A child-resistant container comprising a container body and a closure;

said closure has a first substantially cylindrical body wall;

said closure adapted for slidable longitudinal movement along said interfacing portion of said container body;

a first barrier on said closure;

said interface section has a second substantially cylindrical body wall at least partially located within said first body wall of said closure;

said first barrier structure comprises at least one longitudinal rib extending inwardly from said first body wall;

a second barrier structure on said interfacing portion;

said second barrier structure having at least one opening therein;

said first and second barrier structure cooperating to prevent longitudinal movement of said closure with respect to said interfacing portion of said container body unless said first barrier structure may enter and pass through said at least one opening;

said first and second barrier structures further cooperating to permit exclusively longitudinal movement of said closure with respect to said interfacing portion of said container body when said first barrier structure enters said at least one opening;

said interfacing portion having defeatable interference means for resisting said first barrier structures from entering said at least one opening;

said interference means comprises a cylindrical ledge of increased diameter provided on an exterior surface of said second body wall; and said diameter of said interference means is selected so that said interference means interferes with said first barrier structure upon attempted longitudinal movement of said closure.

9. The article of claim 8 wherein:

said closure has closed position and an open position;

said first barrier structure occupying a first position when said closure is in its closed position and a second position when said closure is in its open position;

said first barrier structure moving past said second barrier structure when said closure is moved from said closed position to said open position; and said interference means is interposed between said first position and said second barrier structure.

10. A child-resistant container comprising a container body and a closure;

said container body having a portion for interfacing with said closure;

said interfacing portion having a substantially cylindrical side wall, a first open end, and a second closed end;

said closure having a substantially cylindrical side wall, first and second ends, and an end wall attached to said side wall at said first end;

said closure arranged telescopically about said interfacing portion of said container body;

said closure having a dispensing orifice formed in said side wall;

said closure having a closed position and an open position;

said interfacing portion side wall extending toward said closure end wall and beyond said dispensing orifice only when said closure is in said closed position;

said closure has a longitudinal axis;

said dispensing orifice has a bottom edge substantially perpendicular to said axis;

said dispensing orifice has side edges substantially parallel to said axis; and said dispensing orifice extends continuously from said bottom edge to said closure end wall.

11. A child-resistant dispensing container comprising a body and a closure, said body having an interfacing portion for interfacing with said closure, said interfacing portion having a longitudinal axis extending in a first direction, said closure being telescopically mounted to said body, said closure being adapted for rotation about said axis, said closure being adapted for limited movement along said first direction, locking means for preventing movement of said closure in said first direction unless said closure occupies a desired predetermined angular orientation with respect to said body, defeatable means separate from said locking means for resisting movement of said closure in said first direction regardless of whether said closure occupies said predefined angular orientation with respect to said body, and said locking means comprising a plurality of longitudinal splines provided on one of said container body or said closure and a corresponding plurality of longitudinal slots on the other of said container body or said closure.

* * * * *